US006000226A

United States Patent [19]

Lee et al.

[11] Patent Number: 6,000,226

[45] Date of Patent: Dec. 14, 1999

[54] METHOD AND APPARATUS FOR STORING AND DISPENSING A LIQUID COMPOSED OF OXYGEN CONTAINING MIXTURE

[75] Inventors: Ron C. Lee, Bloomsbury; Mark Thomas Grace, Bridgewater, both of N.J.

[73] Assignee: The BOC Group, Inc., New Providence, N.J.

[21] Appl. No.: 09/126,479

[22] Filed: Jul. 30, 1998

[51] Int. Cl.[6] ..... F17C 7/04

[52] U.S. Cl. ..... 62/48.1; 62/49.2; 62/50.2

[58] Field of Search ..... 62/48.1, 49.2, 62/50.2

[56] References Cited

U.S. PATENT DOCUMENTS 5,571,231 11/1996 Lee ..... 62/48.2
5,579,646 12/1996 Lee ..... 62/49.2
5,778,680 7/1998 Wardle ..... 62/49.2

*Primary Examiner*—Ronald Capossela
*Attorney, Agent, or Firm*—David M. Rosenblum; Salvatore P. Pace

[57] ABSTRACT

A method and apparatus for storing and dispensing a liquid consisting of an oxygen containing mixture so that the liquid will not contain any more than a predetermined concentration of the oxygen at a predetermined pressure. In accordance with the invention, the mixture is introduced into the container at a specified initial concentration. A hypothetical volume of the saturated state of the liquid having the initial concentration is computed that when expanded into the total volume of the container, the resulting liquid would have the maximum enrichment. The liquid is dispensed from a bottom region of the container and dispensing is prevented when the liquid remaining within the container could possibly have the maximum enrichment computed at a particular dispensing pressure. Pressure relief methods are employed that avoid head space vapor being vented.

5 Claims, 2 Drawing Sheets

METHOD AND APPARATUS FOR STORING AND DISPENSING A LIQUID COMPOSED OF OXYGEN CONTAINING MIXTURE

BACKGROUND OF THE INVENTION

The present invention relates to a method and apparatus for storing and dispensing a liquid composed of an oxygen containing mixture, for instance a mixture of oxygen and nitrogen. More particularly, the present invention relates to such a method and apparatus in which the liquid is stored and dispensed from a container in a manner to ensure that the liquid being dispensed will contain no more than a predetermined concentration of the oxygen. Even more particularly, the present invention relates to such a method and apparatus in which dispensing is prevented when a volume of liquid remaining in the container is equal to a hypothetical volume of the liquid in a saturated state that is calculated at a particular dispensing pressure to contain the predetermined concentration of the oxygen.

The storage and dispensing of oxygen containing mixtures (for instance, synthesized mixtures of oxygen and nitrogen or liquid air for that matter) can be problematical because the nitrogen will preferentially boil off before the oxygen. The end result will be that a liquid will remain that becomes ever enriched in oxygen. Oxygen enriched mixtures can be particularly dangerous around hydrocarbons. For this reason, the prior art has provided numerous pressure relief devices in which liquid from the bottom of the container is passed through a heat exchanger in the head space of the container to collapse nitrogen enriched vapor back into the liquid. The liquid is then vaporized and vented. Examples of this can be found in U.S. Pat. No. 5,571,231 in which an external condensing coil system is provided to allow conversion of a standard liquefied gas container for use in storing mixtures of liquid oxygen and liquid nitrogen.

The shortcoming of this prior art method is that while there is no net change in bulk concentration, local variations in concentration are not guaranteed. As such, there is never a guarantee that the mixture actually being dispensed will not in fact exceed the permissible oxygen concentration.

As will be discussed, the present invention provides a method of storing and dispensing a liquid consisting of an oxygen containing mixture to prevent the dispensed liquid from having an oxygen concentration above a predetermined, allowable level.

SUMMARY OF THE INVENTION

In accordance with the present invention, a method is provided for storing and dispensing a liquid consisting of an oxygen containing mixture to ensure that the liquid will contain no more than a predetermined concentration of oxygen. In accordance with the method, the liquid is introduced into a container. The liquid upon introduction has a known, initial concentration of the oxygen. The liquid is then dispensed from a bottom region of the container and the container is maintained at a dispensing pressure no greater than a specific pressure without venting head space vapor from the container. Liquid is prevented from being dispensed when the volume of the liquid remaining within the container is about equal to a hypothetical volume of the liquid in a saturated state that is calculated at the specific pressure to have the predetermined concentration of the oxygen. The hypothetical liquid volume is that obtained by expansion of an initial volume of the liquid, in a saturated state and having the initial concentration, into a total volume of the container.

In another aspect, the present invention provides an apparatus for storing and dispensing a liquid consisting of an oxygen containing mixture that ensures that the liquid dispensed will contain no more than a predetermined concentration of oxygen. The apparatus has a container adapted to receive the liquid. The liquid has a known, initial concentration of the oxygen. The container is provided with a bottom outlet for dispensing the liquid from a bottom region of the container. A means is provided for maintaining the container at a dispensing pressure no greater than a specific pressure without venting head space vapor from the container. A level detector is also provided for detecting a level of the liquid that is referable to the volume of the liquid. A remotely activated valve is connected to the bottom outlet. The remotely activated valve has a closed position to cut off the flow of the liquid from the bottom outlet. A controller, responsive to the level detector and connected to the remotely activated valve, is configured to activate the remotely activated valve into its closed position when the liquid level is indicative that the liquid volume of the liquid remaining within the container is about equal to a hypothetical liquid volume of the liquid. This hypothetical volume of the liquid is in a saturated state and is calculated at the specific pressure to have the predetermined concentration of the oxygen. The hypothetical liquid volume is that obtained by expansion of an initial volume of the liquid, in a saturated state and having the initial concentration into a total volume of the container.

To practice the invention, a specific hypothetical volume of the saturated state of the mixture is calculated. This saturated state has an initial concentration of the oxygen and its specific volume is so calculated that dispensing a remaining volume of the mixture in a subcooled state would leave remaining within the container a saturated liquid having the predetermined concentration of the oxygen at the predetermined pressure. The subcooled liquid is dispensed from a bottom region of the container so that it is the subcooled liquid that is initially dispensed. The container is maintained at a dispensing pressure no greater than the predetermined pressure without venting head space vapor.

The present invention assumes that liquid will never be dispensed with a concentration above the predetermined or allowed concentration of oxygen. The method of the present invention is not used to calculate the actual physical state of the liquid being dispensed or actual conditions within the container from which the liquid was dispensed. Rather, the invention method is predicated upon a visualization of the worst case scenario for oxygen enrichment of a mixture of nitrogen and oxygen contained within a non-vented container. This worst case scenario will occur in an undisturbed saturated layer of the liquid overlying a subcooled layer. An undisturbed saturated layer will occur if liquid is withdrawn from the tank at a rate which balances the natural heat leak that otherwise would cause a rise in pressure. In this case, neither venting nor pressure building will occur that would disturb the top saturated layer. The worst case scenario continues with the assumption that all the bottom, subcooled, liquid is withdrawn. During this withdrawal, the mass of gas in the top of the container increases. The mass for this gas is provided exclusively from the top saturated layer, which enriches in oxygen due to the preferential vaporization of nitrogen. At the point that all the subcooled bottom liquid is withdrawn, the amount of oxygen enrichment in the saturated layer will be a unique function of the initial thickness of the saturated layer. An extremely thick saturated layer will enrich only slightly because of its greater mass, while an extremely thin layer will enrich considerably.

A specific hypothetical volume of the saturated liquid layer is calculated such that the oxygen enrichment when all of the subcooled liquid is withdrawn is equal to the predetermined maximum concentration of oxygen. Put another way, a specific volume of saturated liquid having a known, initial concentration of oxygen will exist so that when expanded into the entire volume of the container, a volume of saturated liquid will remain that has the predetermined, concentration of the oxygen.

Although the initial saturated layer is of unknown initial thickness, for a given allowable liquid oxygen enrichment, there is only one unique layer thickness for the initial layer and a single unique layer thickness for a final layer. For a container of constant cross-section, it follows that when the liquid reaches a specific liquid level height, as a worst case such liquid would have the specific enrichment. Assuming a series of initial volumes of saturated layers having initial oxygen concentrations and final saturated mixtures containing oxygen, widely known vapor-liquid equilibrium data will supply the oxygen concentration in the remaining saturated liquid after all of the subcooled liquid has been dispensed. Thus, data can be developed that, for a given constant pressure, correlates oxygen concentration on a mass basis in the final saturated mixture with initial thicknesses of saturated layers of specific oxygen concentration, for instance, 21%.

It should be pointed out that the actual, initial saturated layer thickness is not material. If such a layer were thicker, then less enrichment in the saturated liquid occur and liquid having an improper degree of enrichment will never be withdrawn. If such a layer were thinner, then saturated liquid would never be withdrawn in the first instance because withdrawal is limited to the allowable liquid level height. For an extremely thin saturated layer, the enrichment can be sufficient that the density of the top saturated layer exceeds the density of the bottom subcooled layer. In that case, growth or turnover of the saturated layer occurs that effectively mixes the top saturated layer with at least a portion of the bottom subcooled layer. The net result of this growth or turnover is a decrease in the degree of enrichment.

With the foregoing procedure in mind, after a volume of liquid is dispensed and the liquid volume of the liquid remaining within container could hypothetically contain the oxygen enrichment that would be unsuitable for the intended application, either dispensing can be safely stopped or the container can be refilled.

BRIEF DESCRIPTION OF THE DRAWINGS

While the specification concludes with claims distinctly pointing out the subject matter that applicants regard as their invention, it is believed the invention will be better understood when taken in connection with the accompanying drawing in which:

DETAILED DESCRIPTION

Figure 1:
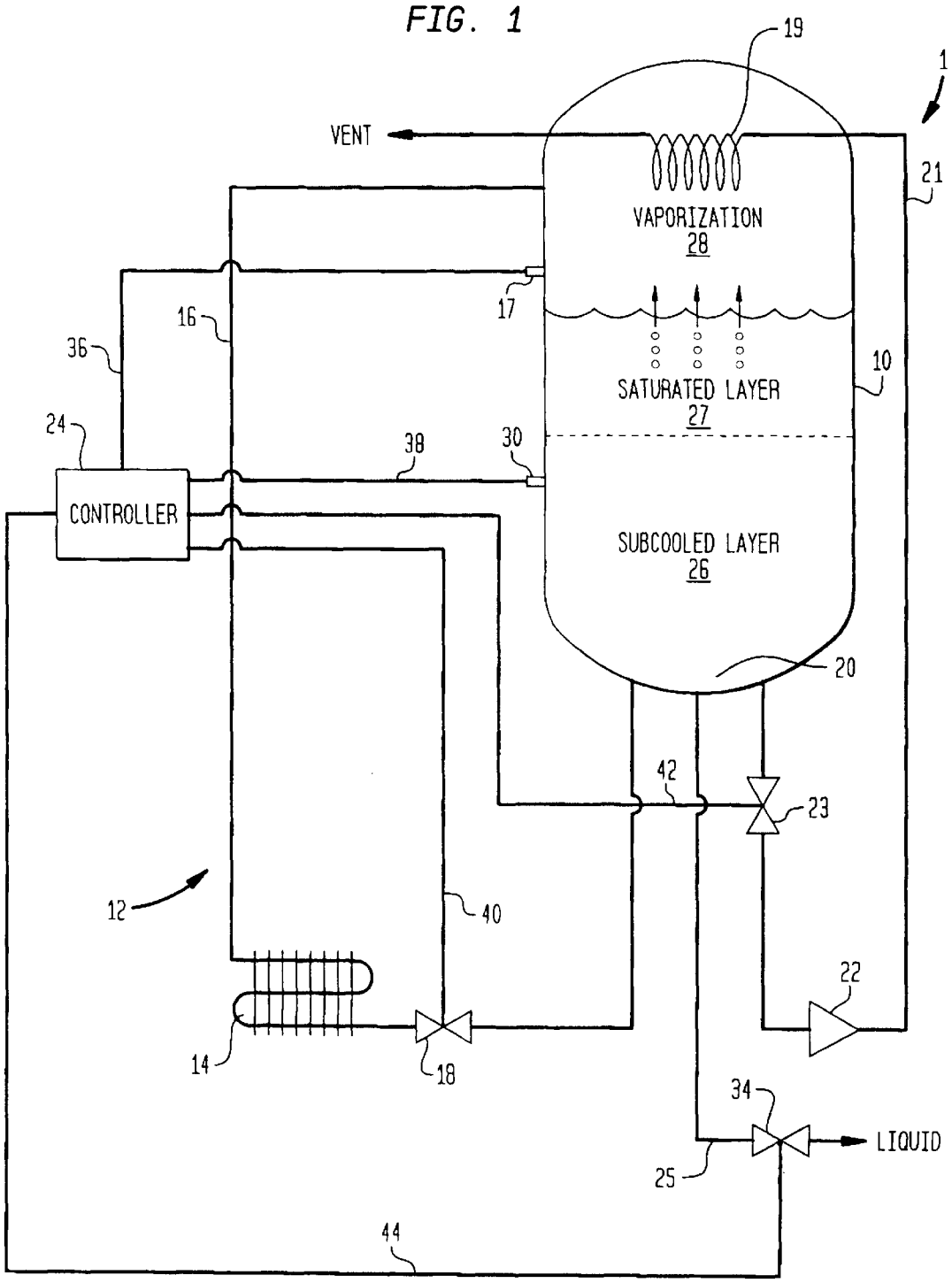
FIG. 1 is a schematic of a container for carrying out a method in accordance with the present invention.

With reference to FIG. 1, an apparatus 1 in accordance with the present invention is illustrated. Apparatus 1 consists of a container 10 designed to store the liquid to be dispensed at a substantially constant pressure. To this end, container 10 is provided with a pressure building circuit 12 including a heat exchanger 14 and a vapor line 16 to return vaporized liquid to the head space. The action of pressure building circuit 12 is controlled by sensing head space pressure by a pressure sensor 17 and appropriately adjusting flow rate therein by a control valve 18. Additionally, a condensing coil 19 is provided in communication with a bottom region 20 of container 10 by way of a conduit 21 having a pressure reducing orifice 22 to allow liquid to collapse head space vapor within container 10. A control valve 23 is provided for condensing coil 19 which together with control valve 18 functions to control the pressure within container 10 without venting head space vapor. The liquid is dispensed from bottom region 20 of container 10 through an outlet line 25.

It is to be noted that control valves 18 and 23 are controlled in a known manner by a controller 24 which can be a programmable digital device, also well known in the art As will be discussed, controller 24 has inputs to control the dispensing in response to sensed liquid level within container 10. A further point is that although the method of the present invention can function with container 10 below the predetermined pressure, such method will not function if the pressure within container 10 is allowed to rise very much above such pressure. In this regard, preferably the pressure within the container is controlled to be substantially equal to the predetermined pressure which typically will be plus or minus 0.5 bar of the predetermined pressure. substantially equal to the predetermined pressure which typically will be plus or minus 0.5 bar of the predetermined pressure.

Container 10 is typically filled from a low pressure source with the aid of a pump. Pumping produces subcooling within the liquid which is introduced into the tank by a combination of top and bottom filling to maintain pressure. Assuming the tank is nearly filled, a subcooled layer 26 will exist beneath a saturated layer 27. As subcooled liquid is withdrawn, head space region 28 will be formed in which liquid in the saturated layer vaporizes to cause enrichment of remaining liquid within the saturated layer 27.

Given the foregoing, at both a specific pressure and a specific target concentration, a hypothetical volume of saturated liquid can be computed that would be left remaining at the specific pressure and target concentration if all of the subcooled liquid were withdrawn. This hypothetical volume of saturated liquid implies a unique allowable liquid level height. For a container 10 of vertical cylindrical configuration, the allowable liquid level is simply calculated from knowledge of the hypothetical volume of saturated liquid. As can be appreciated, more complex tank configurations will require correspondingly more complex calculations to correlate the allowable liquid level height with the hypothetical volume of saturated liquid. In this regard, although not illustrated, the present invention would have to other types of tanks, for instance a tank in a horizontal orientation.

Since the pressure of container 10 is controlled by a combination of control valve 18 and control valve 23, all that remains is to monitor the liquid level within tank 10 using level sensor 30. When the liquid level falls below the allowable liquid level, controller 24 is also configured to trigger a valve 34 to assume a closed position. It is to be noted, that controller 24 receives pressure and level inputs through electrical connections 36 and 38, respectively, and controls valves 18, 23, and 34 through electrical connections 40, 42, and 44, respectively.

Thus, the controller 24 and valve 34 act as an interlock. Upon reaching the allowable liquid level, container 10 could be refilled. As could be appreciated, controller 24 could additionally, or alternatively, be set up to trigger an alarm to alert personnel to refill container 10. This alarm might be triggered well in advance of the triggering of valve 34 to allow personnel to appropriately react. Additionally, although not illustrated, any pipeline being used to dispensing the oxygen containing liquid after shut-down would be purged with nitrogen to prevent pooled liquid from becoming dangerously enriched with the oxygen.

Figure 2:
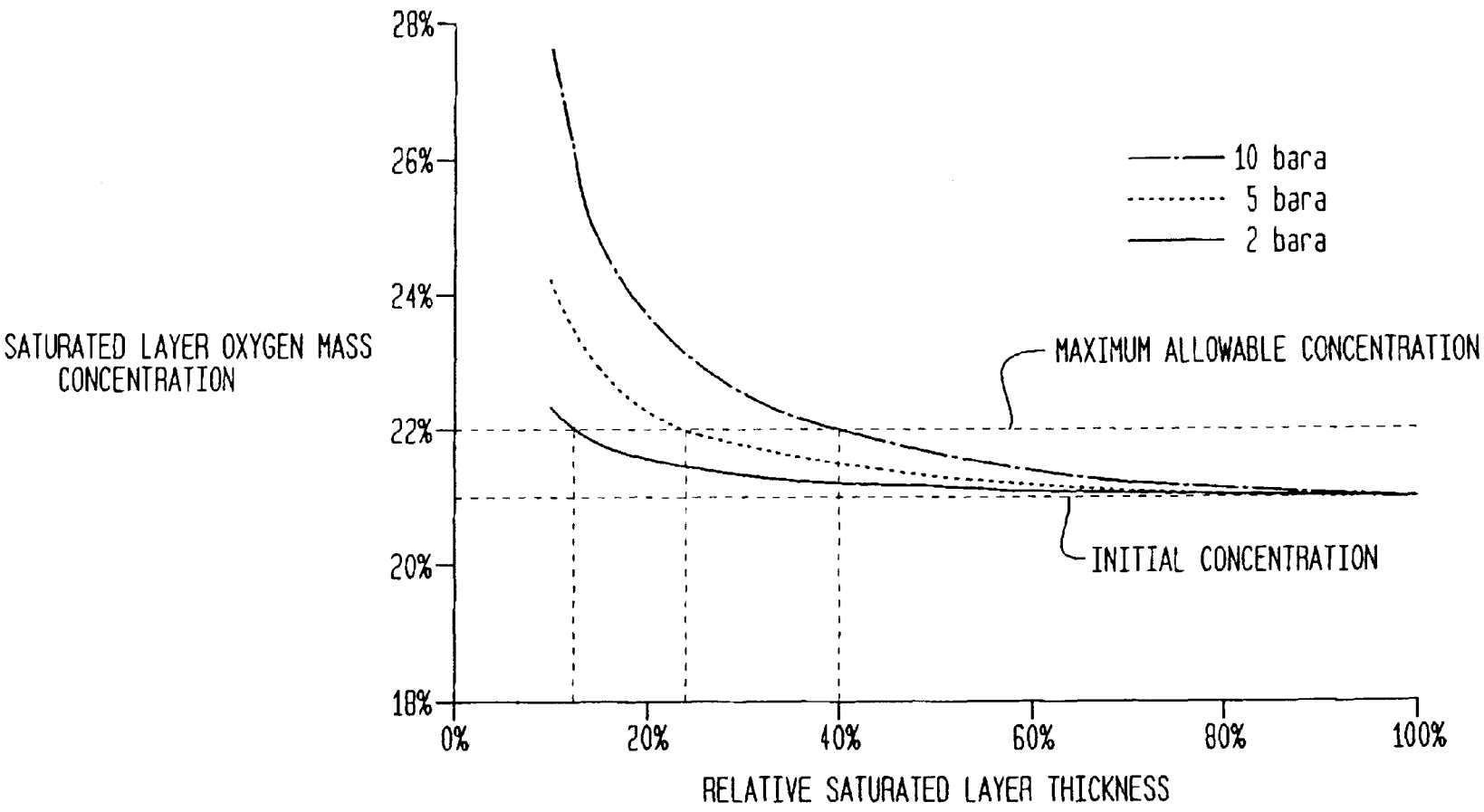
FIG. 2 is a series of curves representing the calculation of the thickness of a hypothetical, initial layer of saturated liquid.

With reference to FIG. 2, as examples, the relative saturated layer thickness, which is the saturated layer volume as compared to the subcooled layer volume, was used to simplify the calculations. These calculations were performed at specific pressures of 10 bar absolute (bara), 5 bara and 2 bara and on a mass basis. The assumptions used in performing such calculation were that the entering concentration of the oxygen and nitrogen containing mixture was 21% and the maximum allowable concentration was about 22%. Under such circumstances, if the liquid were to be dispensed at 2 bara, the initial saturated layer (having the initial concentration of 21%) would have a relative thickness of about 12%. For 5 bara dispensing, the initial saturated layer would have a relative thickness of about 25%. At a dispensing pressure of 10 bara, the initial saturated layer would have a relative thickness of about 37%. All that remains is to compute the saturated layer thickness that would exist if such initial saturated layers were expanded into the entire volume of the container. This can be done on the basis of vapor-liquid equilibrium data and the result is that for the 2 bara dispensing, the relative final thickness would be about 11%, for the 5 bara dispensing about 23%, and for 10 bara dispensing, about 33%. This final calculation therefore represents a hypothetical volume (on a relative height basis) of saturated liquid having the initial entering concentration expanded into the volume of the container and thus, having the final concentration predetermined not to be suitable for the particular application for the liquid.

Thus, for a 5 bar dispensing, after the height of liquid fell to a height equal to about 23% of the height of container 10, control valve 32 would be set in a closed position. As can be appreciated by those skilled in the art, the height or volume that control valve 32 will react will only be substantially equal to the hypothetical volume (or more properly height) within the limits of the level sensor being used, which normally is about 10%. Thus, control valve 32 could be triggered at a slightly higher liquid level that that exactly corresponding to that of the hypothetical volume of liquid having the final predetermined concentration. In accordance with the example, during the dispensing, container 10 would be maintained at 5 bara by action of control valves 18 and 23.

Although the present invention has been described with reference to preferred embodiment, as will occur to those skilled in the art, numerous changes, additions and omissions may be made without departing from the spirit and scope of the present invention.

We claim:

1. A method of storing and dispensing a liquid consisting of an oxygen containing mixture to ensure that said liquid will contain no more than a predetermined concentration of oxygen, said method comprising;

introducing said liquid into a container, the liquid upon introduction having a known, initial concentration of said oxygen;

dispensing said liquid from a bottom region of said container;

maintaining said container at a dispensing pressure no greater a specific pressure without venting head space vapor from said container; and preventing liquid from being dispensed when liquid volume of said liquid remaining within said container is substantially equal to a hypothetical liquid volume of said liquid in a saturated state calculated at a specific pressure to have said predetermined concentration of said oxygen;

said hypothetical liquid volume being that obtained by expansion of an initial volume of said liquid, in a saturated state and having said initial concentration, into a total volume of said container.

2. The method of claim 1, wherein said pressure is maintained without venting head space vapor by building pressure by vaporizing said liquid from said bottom region of said container in conjunction with condensing head space vapor with said liquid from said bottom region of said container.

3. The method of claim 1, wherein:

said container has a constant transverse cross-section;

said height of said liquid within said container is sensed; and dispensing of said liquid is terminated upon said height reaching a value corresponding to said remaining volume.

4. The method of claim 2, wherein:

said container has a constant transverse cross-section;

said height of said liquid within said container is sensed; and dispensing of said liquid is terminated upon said height reaching a value corresponding to said remaining volume.

5. An apparatus for storing and dispensing a liquid consisting of an oxygen containing mixture that ensures that the liquid dispensed will contain no more than a predetermined concentration of oxygen;

a container adapted to receive said liquid, the liquid having a known, initial concentration of said oxygen;

the container having a bottom outlet for dispensing said liquid from a bottom region of said container;

means for maintaining said container at a dispensing pressure no greater than a specific pressure without venting head space vapor from said container; and a level detector for detecting a level of liquid referable to liquid volume of said liquid;

a remotely activated valve connected to said bottom outlet and having a closed position to cut off the flow of said liquid from said bottom outlet; and a controller responsive to said level detector and connected to said remotely activated valve, the controller configured to activate said remotely activated valve into its said closed position when said liquid level is indicative that the liquid volume of said liquid remaining within said container is substantially equal to a hypothetical liquid volume of said liquid in a saturated state calculated at said specific pressure to have said predetermined concentration of said oxygen;

said hypothetical liquid volume being that obtained by expansion of an initial volume of said liquid, in a saturated state and having said initial concentration, into a total volume of said container.

* * * * *